US005709623A

United States Patent [19]

Schwaner

[11] Patent Number: 5,709,623

[45] Date of Patent: Jan. 20, 1998

[54] BALL CASING, IN PARTICULAR A SOCCER BALL CASING

[75] Inventor: Michael Schwaner, Bubenhofenstrasse, Germany

[73] Assignee: Uhlsport GmbH, Balingen, Germany

[21] Appl. No.: 718,935

[22] Filed: Sep. 24, 1996

[30] Foreign Application Priority Data

Nov. 7, 1995 [DE] Germany ..... 195 41 395.4

[51] Int. Cl.[6] ..... A63B 41/00

[52] U.S. Cl. ..... 473/604; 473/607

[58] Field of Search ..... 473/597, 598, 473/599, 600, 601, 602, 603, 604, 605, 607, 608, 612; 40/327

[56] References Cited

U.S. PATENT DOCUMENTS

| | | | |
|---|---|---|---|
| 1,140,845 | 5/1915 | Oliver et al. | 473/608 |
| 4,542,902 | 9/1985 | Massino | 473/602 |
| 4,830,373 | 5/1989 | Dehnert et al. | 473/599 |
| 5,286,020 | 2/1994 | Caruso | 473/603 |
| 5,603,497 | 2/1997 | Louez | 473/607 |

FOREIGN PATENT DOCUMENTS

| | | |
|---|---|---|
| 17 23 051 | 5/1956 | Germany . |
| 37 26 830 C1 | 12/1988 | Germany . |
| 89 08 027.0 | 9/1989 | Germany . |
| WO 94/03239 | 2/1994 | WIPO . |

*Primary Examiner*—Steven B. Wong
*Attorney, Agent, or Firm*—Shlesinger Arkwright & Garvey LLP

[57] ABSTRACT

A ball casing in particular for soccer balls is composed of flat cutouts stitched together at their edges, the surface of the ball casing evincing a pattern of one group of equilateral polygonal surfaces and one group of equilateral hexagonal surfaces or three-arm star surfaces, each polygonal surface being enclosed by five hexagonal surfaces or by five three-arm star surfaces.

Several equilateral polygonal surfaces or three-arm star surfaces when seen in planar geometric development form at least one integral planar and preferably stamped cutout.

Each pentagonal surface is formed as a separate and preferably stamped cutout. The individual polygonal surfaces each are stitched at all five edges to the associated edges of the common planar cutout(s) containing the hexagonal surfaces or the star surfaces.

6 Claims, 9 Drawing Sheets

BALL CASING, IN PARTICULAR A SOCCER BALL CASING

Figure 1:
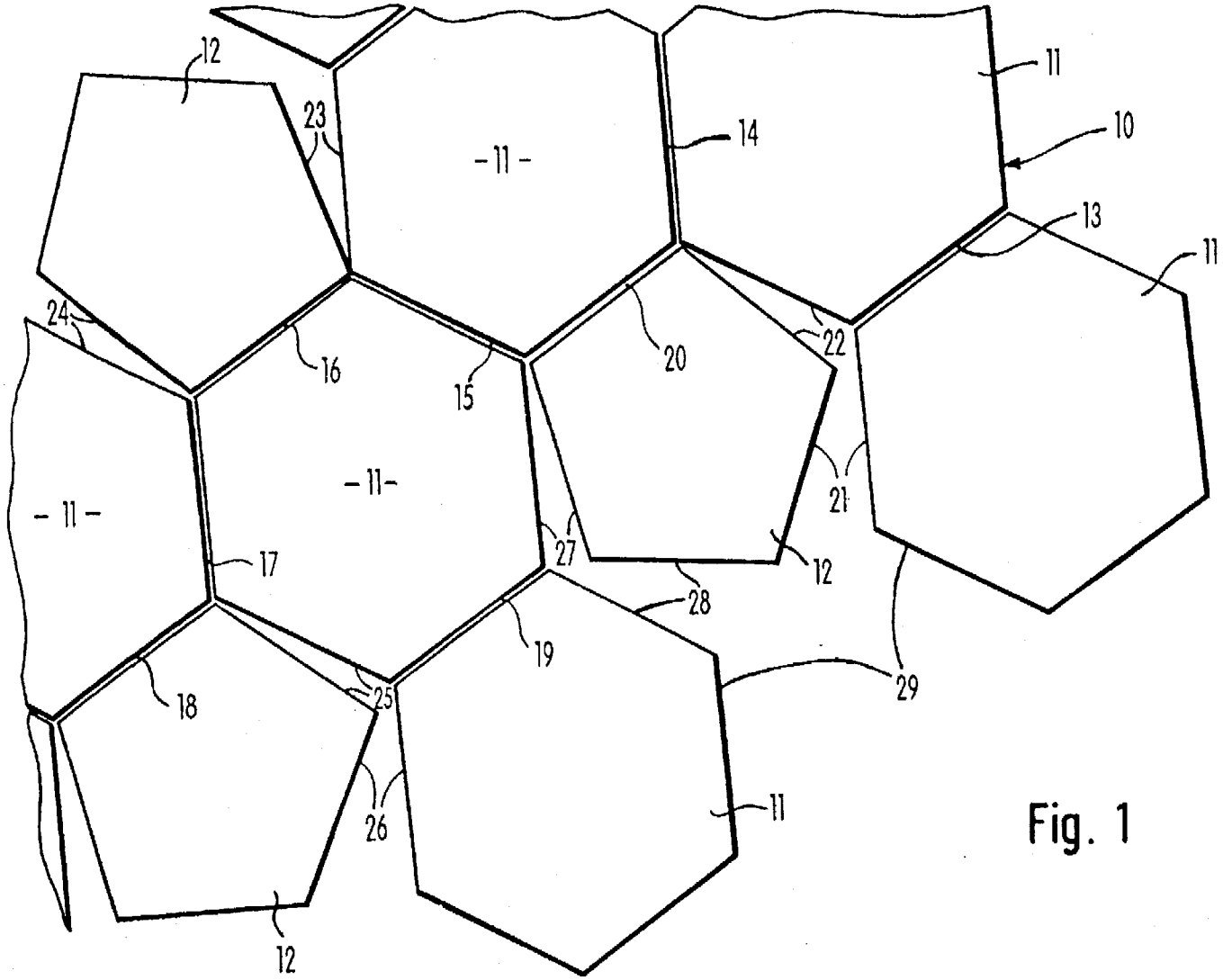

The invention relates to a ball casing.

Known ball casings of the above kind are composed of a combination of twenty equilateral hexagons with twelve equilateral pentagons of equal edge lengths in such manner that one edge of a hexagon adjoins each edge of a pentagon. Illustratively this state of the art is described in the German brochure "B.O.S. Sportbälle, ISPO 1971", page 2. In this state of the art the base areas of the hexagons are substantially larger than those of the pentagons, and as result unequal material stresses are present.

Another ball casing of the species is shown in the German patent document C1 37 26 830. In the state of the art shown in this publication, the ball casing is composed of twelve equilateral polygons and twenty rotationally symmetrical three-arm stars. The advantage of this latter design of known ball casings is that the areas of all component parts are substantially the same and thereby substantially equal material stresses are present in all ball zones (hexagons and stars) when the ball is used in play.

In the two above industrial manufactures of ball casings by joining (sewing) a total of thirty-two elements (stamped cutouts), and in the prior art, the desired optimum is to achieve perfect spherical symmetry of the ball casing (i.e. of the formed ball) with the fewest cutouts.

In this respect it must be borne in mind that stitching together these fairly numerous individual cutouts (ball zones) still must be done completely by hand. If this substantial seam length, entailed by the twelve pentagonal parts and the twenty hexagonal or star parts representing a large number of accruing individual edges or seams, is considered, then it is clear that this manual stitching of the total of thirty-two individual cutouts (ball zones) represents substantial costs in labor and complexity.

In the light of this background, suggestions already have been advanced whether or how the number of ball zones (individual cutouts), ie the summed seam length of such a ball casing might be reduced further. Not only do the seams cause high manufacturing costs, but they also entail in many ways weak spots in the ball casing:

1. Because of the inside ball pressure and play conditions, the stitching thread is especially stressed. The stitching thread tears much more frequently than the leather or plastic material of the zones (individual cutouts) constituting the ball casing.

2. The enveloping spherical surface always touches the ball zones along the ball-zone edges. The edges (always) form small elevations above the mean level of the ball surface. Accordingly each seam entails a break in the roundness of the ball surface, and most of all the ball-zone edges are exposed to high abrasions.

3. The ball inner pressure expands the volume of the ball; therefore the circumference of the ball is ideal only in the exception and varies in relation to the inside pressure. After substantial use, the ball circumference may remain enlarged permanently on account of material fatigue. In such a case the ball becomes too large. To a slight extent the expansion is due to that in the material of the ball zones (individual cutouts) but to a large extent it is due to the seams spreading apart.

4. When the play takes place in a wet ambience, every ball with a stitched ball casing absorbs moisture, and this effect is wholly negative:

The ball becomes heavier in uncontrolled manner and its bounce degrades. Therefore it is a constant objective of all ball manufacturers to reduce water absorption. Moisture penetrates only slightly through the substantially water-impermeable material of the ball casing, but predominantly through the seams into the ball inside where it is stored in the fabric laminate of the ball zones (individual cutouts), in the cavity between the ball casing and bladder and in the stitching thread. Accordingly the water absorption of a ball would be less or at least take place more slowly if it were possible to reduce the total length of ball-casing seam.

Based on the initially cited state of the art and the drawbacks listed in detail, the object of the invention is to substantially shorten the total seam of a ball casing without thereby giving up the best-possible sphericity.

At least in theory the problem of the invention may be solved for a ball casing defined in the preamble of claim 1 by the steps defined in the features part of claim 7, but in practice the alternative solutions defined in claims 1 and 2 are more easily implemented.

The invention is based on the following considerations. When starting with a conventional ball casing composed of twelve pentagonal and of twenty hexagonal ball zones and forming a geometric development of this ball-case pattern, then it follows that only part of the numerous individual seams of such a ball casing require being opened. A large number of seams on the contrary may remain in the "laid-flat" condition of the ball casing. The invention has inferred therefrom that basically those seams are superfluous ab initio. Thus the ball surface material may be constituted in many places to be cohesively together, that is, the seams at those places may be dispensed with. Basically the ball casing might be composed of a single, preferably stamped cutout in that the pattern zones (for instance thirty-two pentagonal and hexagonal ball zones) are made to join by means of a large number of connection sites. In order to stitch the said single cutout into the desired spherical shape, only a minimum of stitch seams would be required compared with the state of the art.

On the other hand the two more practically implementable alternatives of the invention of are based on the consideration that all seams require material addition around the ball-zone contour proper. This requirement is met by the pentagonal ball zones being composed of a single (stamped) cutout.

Figure 3:
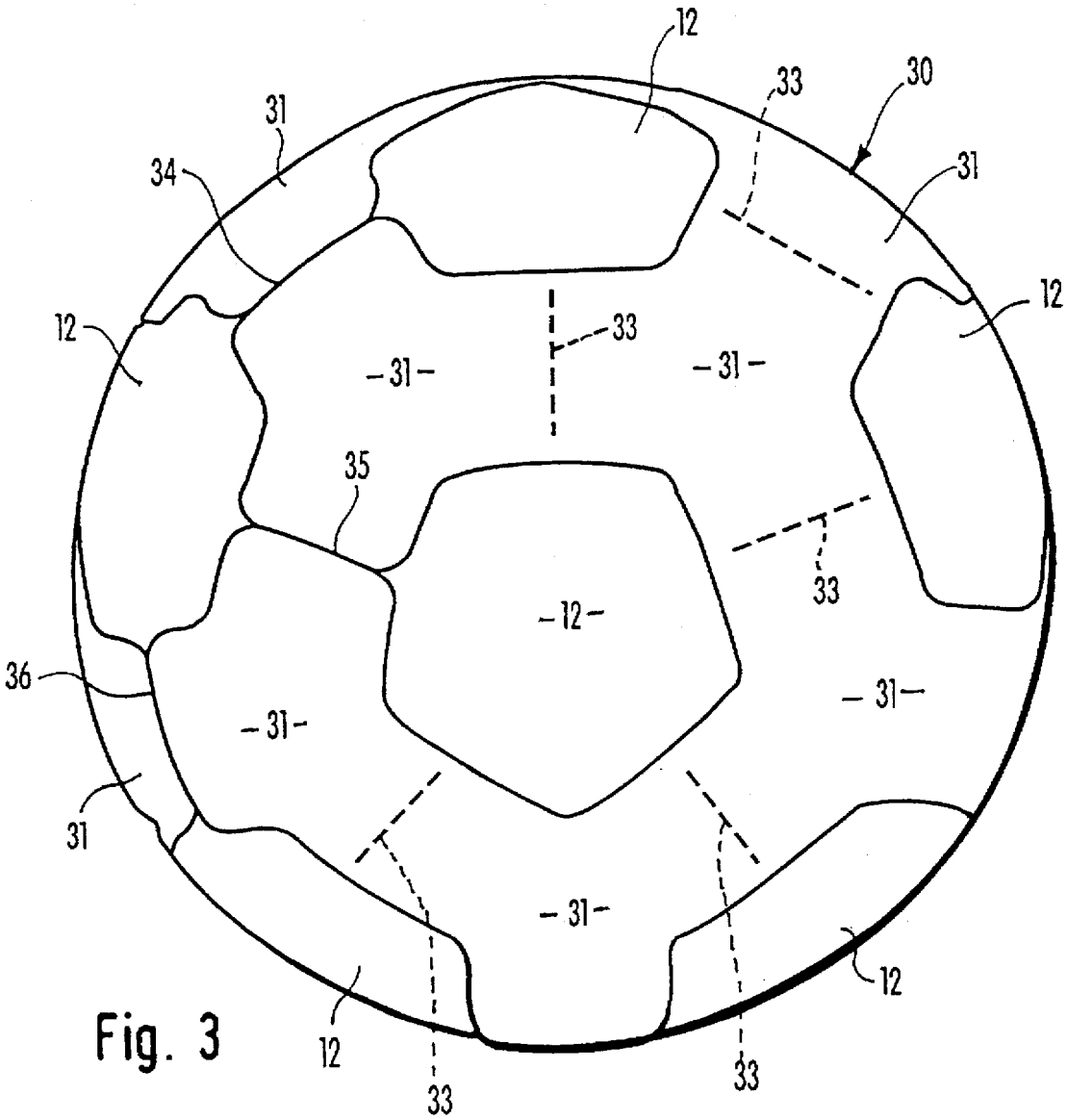

The design shown in FIG. 3 of a ball zone of the invention follows in particular from the inventive concepts of claim 1 or 2. As a result and contrary to the case of conventional ball casings, the maximum number of nineteen seams can be saved. Moreover only thirteen instead of thirty-two single parts are required in manufacture. In this design the ball offers the same optimal sphericity as in the conventional design of thirty-two individual zones (s) (cutouts).

Illustrative embodiments shown in the drawings and elucidating the invention are described below, wherein the cutouts are construed as made by stamping.

Figure 2:
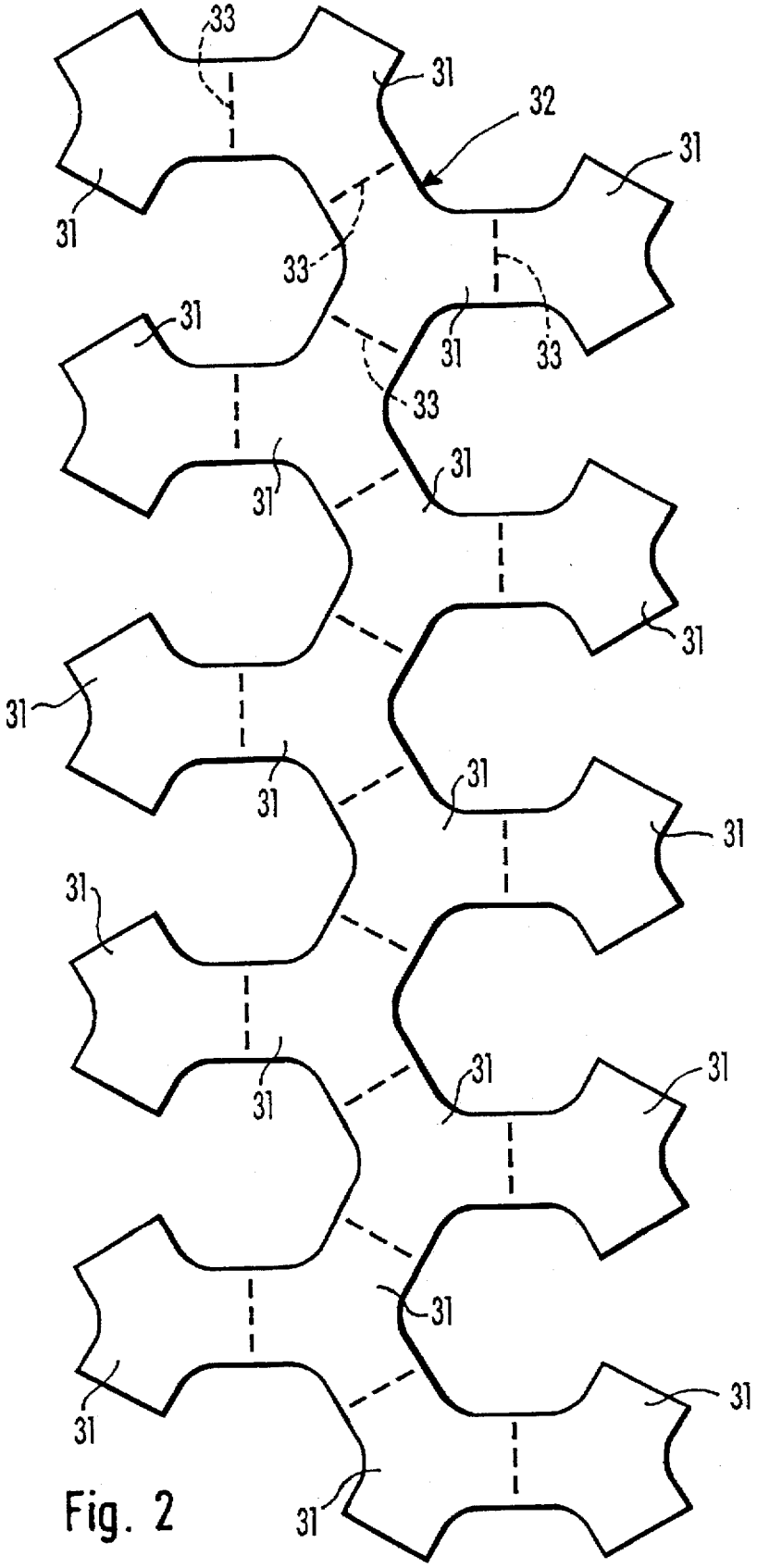
Figure 4:
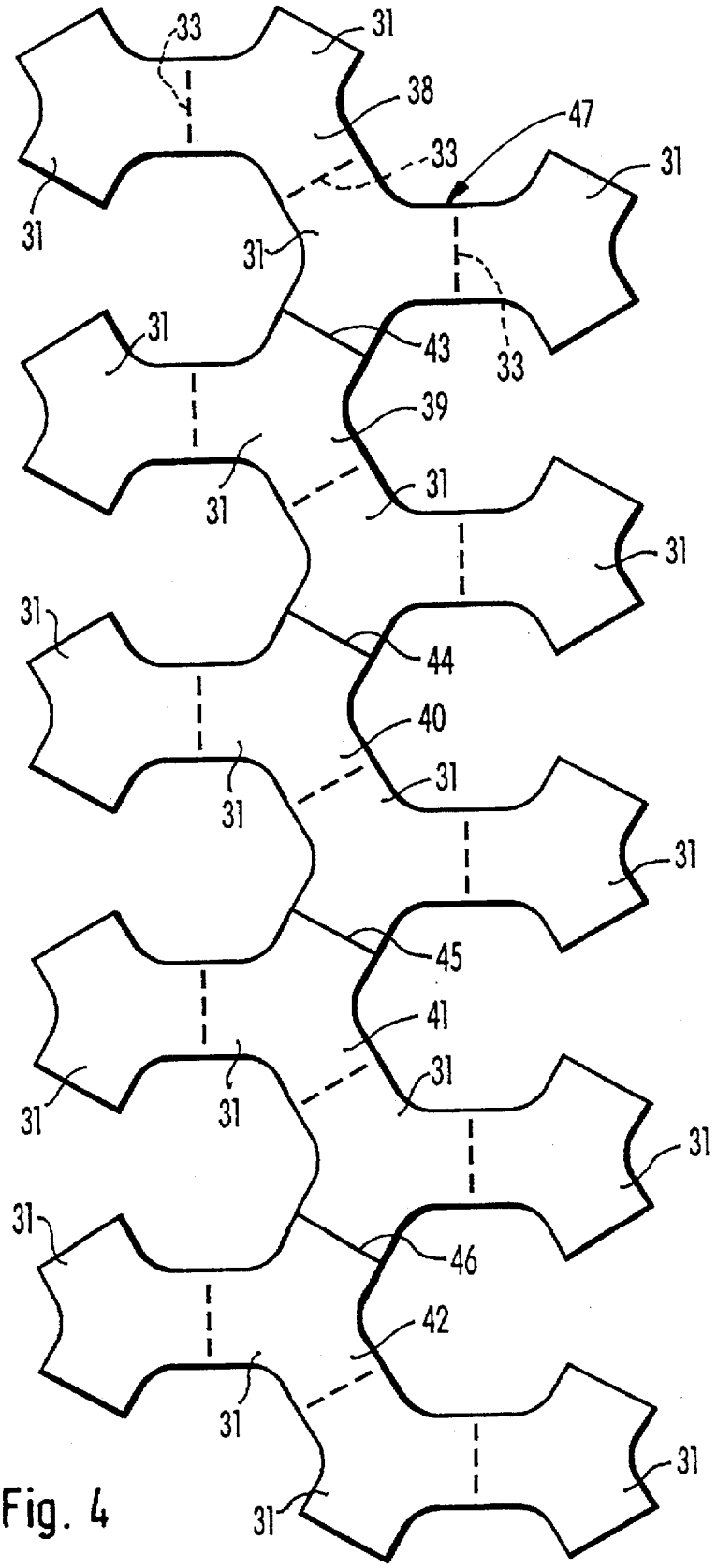
Figure 5:
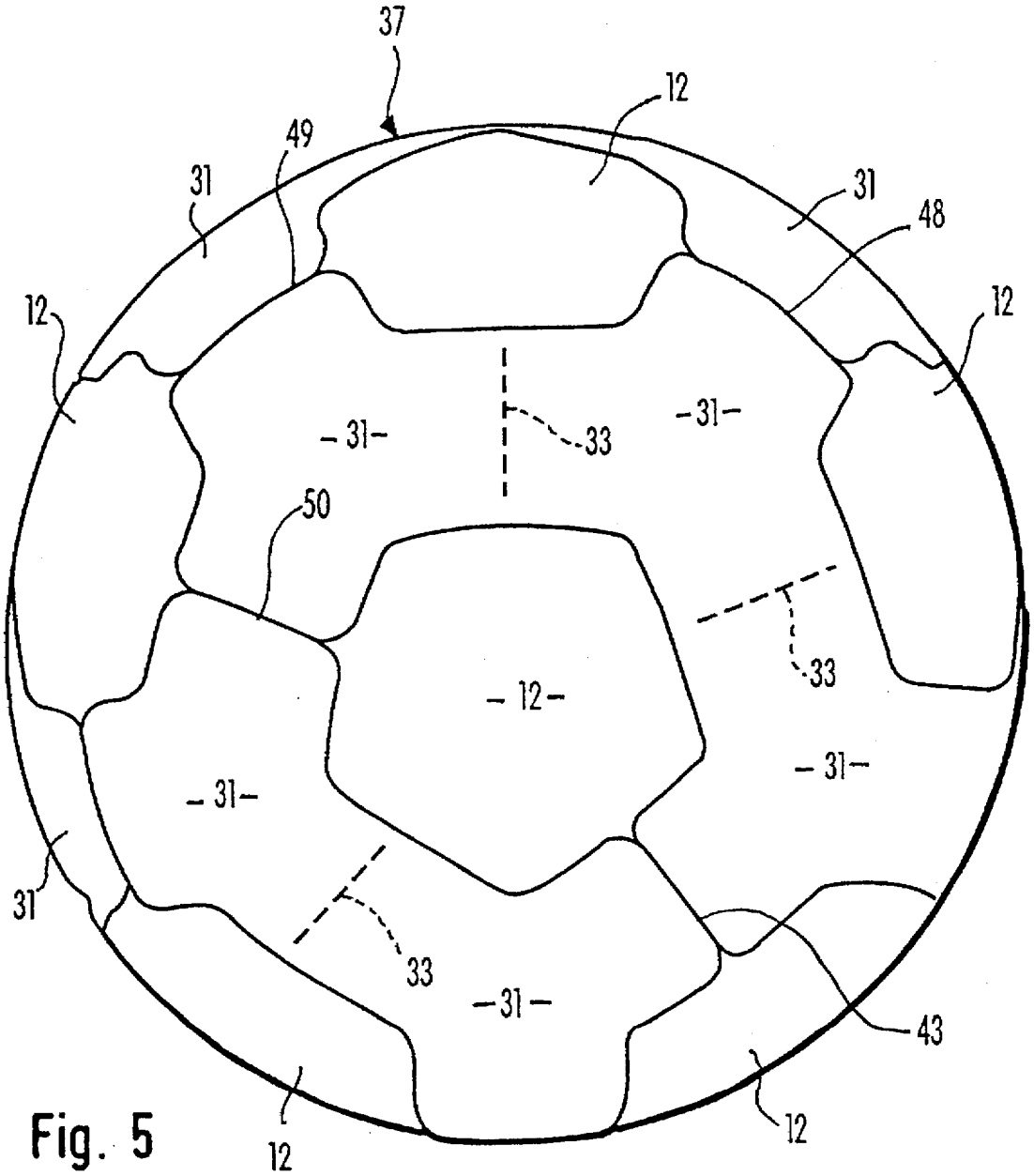
Figure 6:
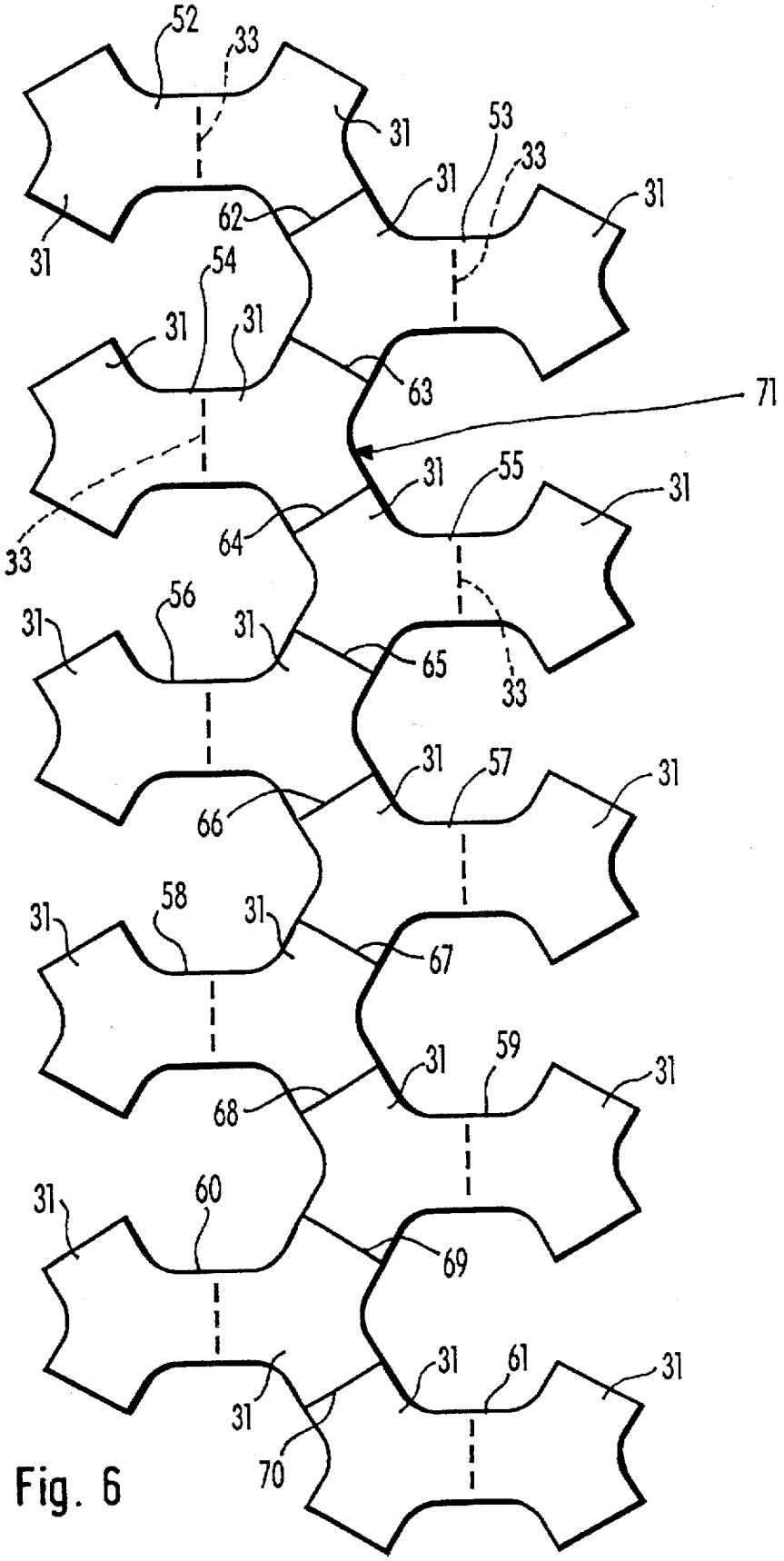
Figure 7:
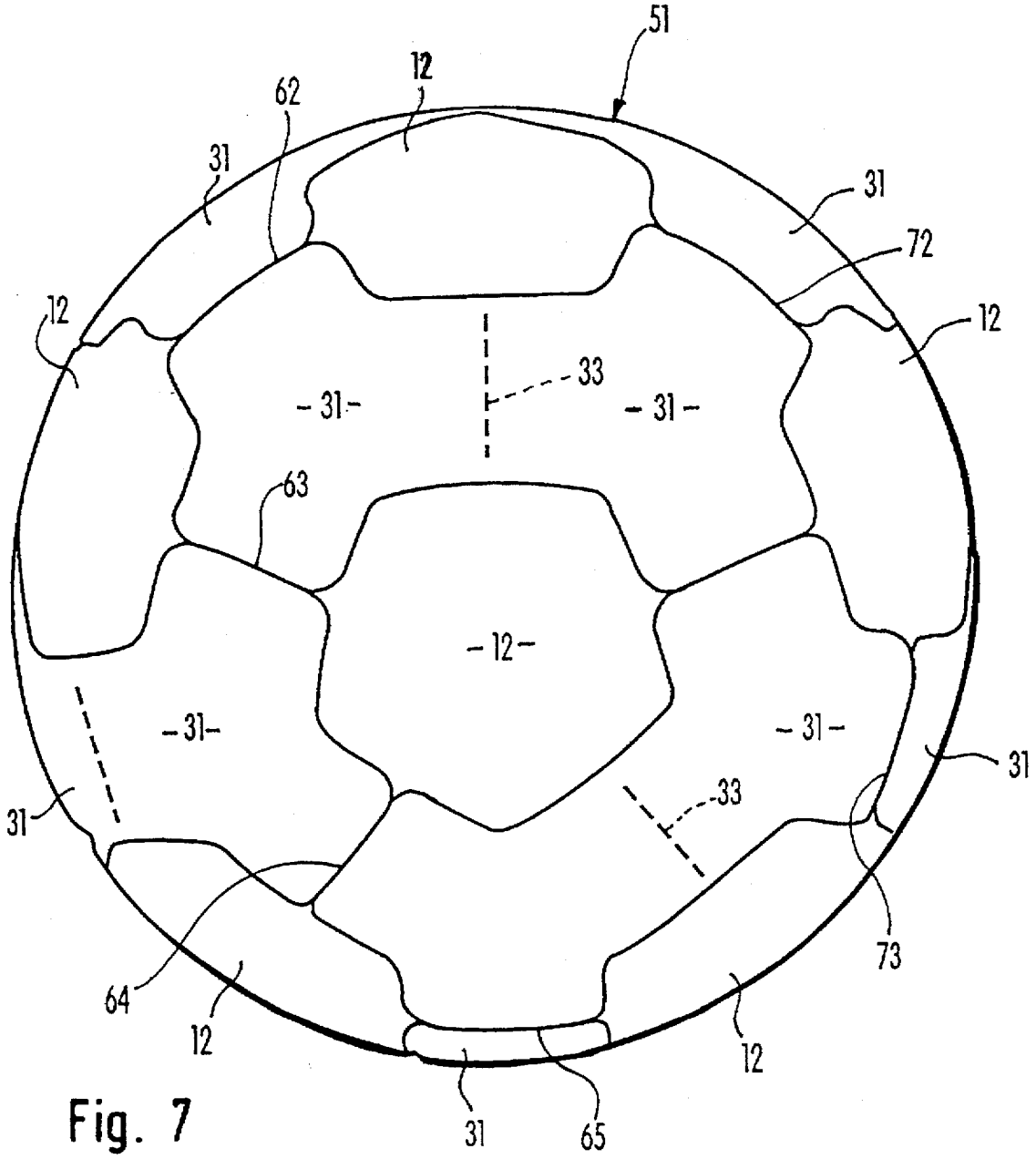
Figure 8:
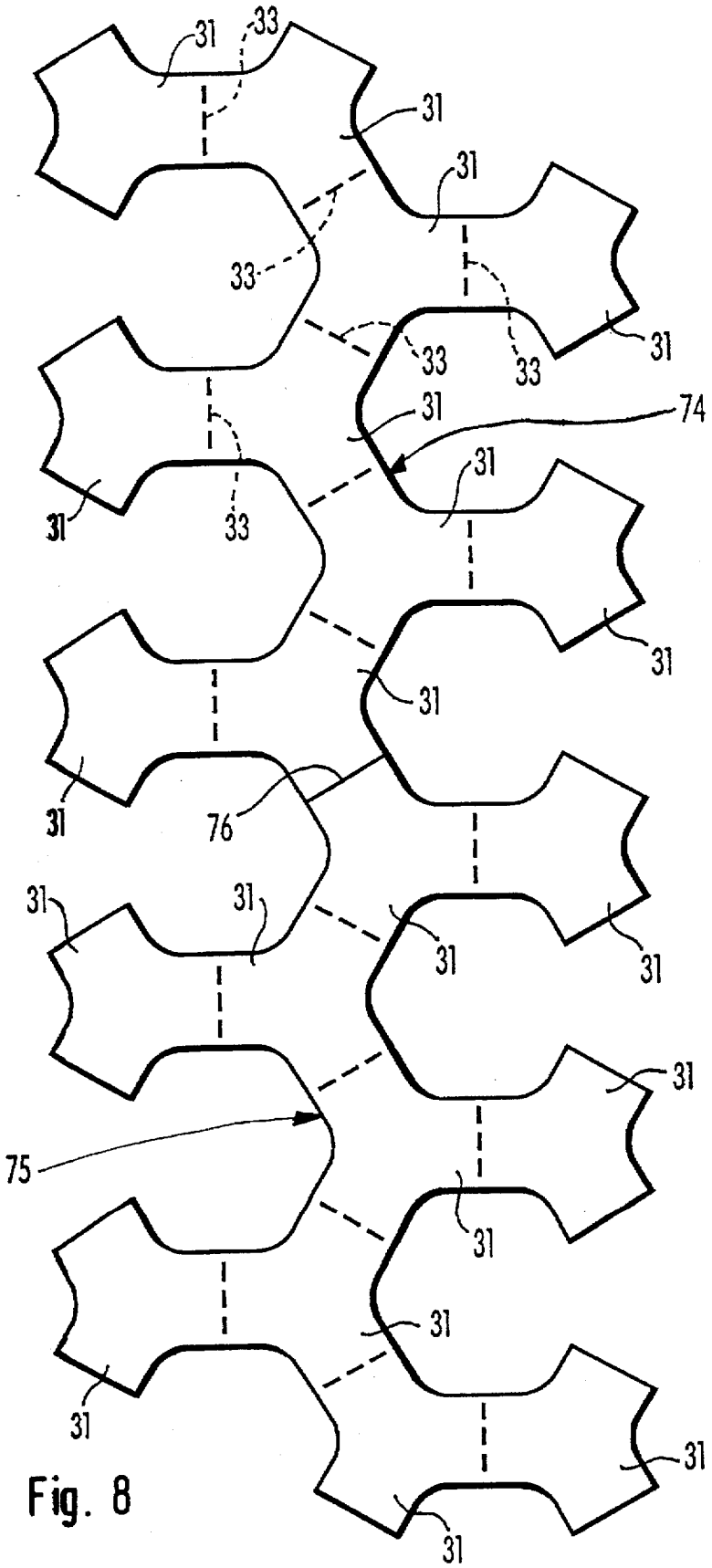
Figure 9:
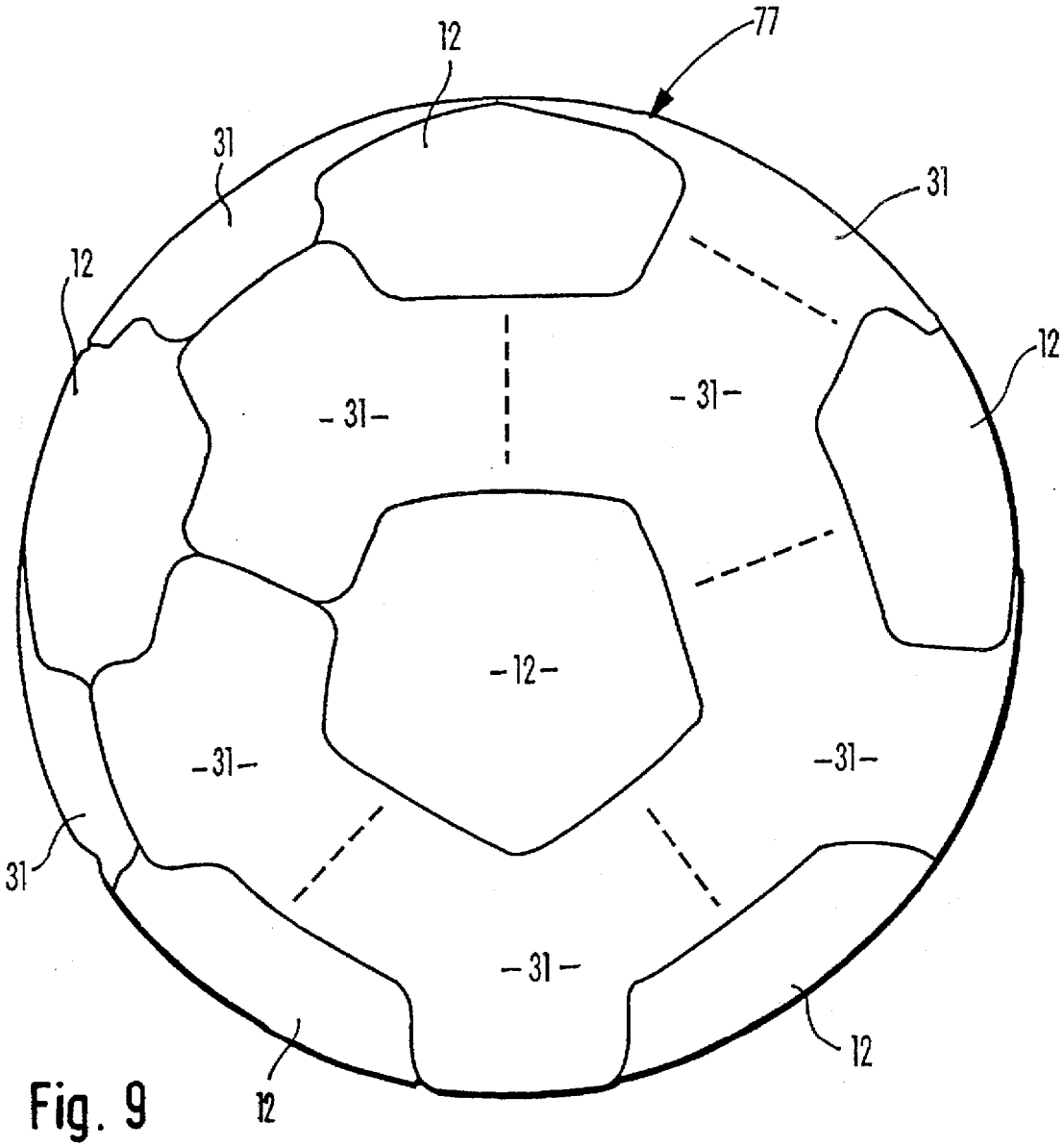

FIG. 1 is an embodiment of a ball casing consisting of a single cutout with a pattern of equilateral polygonal and hexagonal ball zones shown in planar geometric development, FIG. 2 is a planar cutout for another embodiment of a ball casing comprising a total of twenty ball zones in the form of three-arm stars, FIG. 3 is a finished ball composed of a cutout shown in FIG. 2 and of twelve further smaller cutouts (ball zones) in the form of polygonal parts, FIG. 4 is a view similar to that of FIG. 2 of five cutouts stitched together for another embodiment of a ball casing constituted by combining four three-arm star-part areas (ball zones), FIG. 5 shows a finished ball incorporating the five cutouts of FIG. 4 and furthermore twelve smaller cutouts (ball zones) in the form of equilateral polygonal parts, FIG. 6 is a representation similar to FIG. 2 or FIG. 4 of ten cutouts stitched together for a further embodiment of a ball casing constituted by combining two three-arm start-part areas at a time, FIG. 7 is a finished ball built up using ten cutouts of FIG. 6 and further twelve, smaller cutouts (ball zones) in the form of equilateral polygonal parts, FIG. 8 is representation similar to FIGS. 2, 4 or 6 of two cutouts stitched together for a further embodiment of a ball casing formed by combining ten three-arm star-part areas, and FIG. 9 is a finished ball built up using two cutouts of FIG. 8 and furthermore twelve, smaller cutouts (ball zones) in the form of pentagonal parts.

FIG. 1 is a partial view of a ball casing 10 spread in a plane and composed in manner generally known with respect to soccer balls of ball zones 11 in the form of equilateral hexagons and of ball zones twelve in the form of equilateral pentagons. The lateral lengths of the ball zones 11, 12 are identical. Accordingly a pattern of zones is entailed in the finished (spherical) ball casing 10, each pentagonal ball zone 12 being surrounded by six hexagonal ball zones 12. A total of twelve pentagonal ball zones 12 and twenty hexagonal ball zones 11 are present, whereby the ball casing 10 optimally approaches the spherical shape.

Conventional ball casings are made in the pattern shown in FIG. 1 and therefore entail ninety single seams because the pentagonal and the hexagonal ball zones each are in the form of individual parts.

The segment shown in FIG. 1 of a ball casing 10 spread in a plane, i.e. in geometric development, shows that the ball zones 11, 12 are not in the form of individual parts but instead in the form of an integral component cohesive—but not stitched—at the edges 13 through 20. During the "final assembly" of the one-piece ball casing 10 into finished sphericity only the edges 21 through 29 need be connected as regards the segment of the ball casing 10 shown in FIG. 1. (Similar conditions also would apply if the ball casing shown in FIG. 1 were to comprise three-arm star parts such as shown for instance in FIGS. 2 through 9 and denoted therein by 31 instead of the equilateral hexagonal ball zones 11).

However, in order to secure a solution easily implementable in practice, the (rather theoretical) example shown in FIG. 1 should be modified in that only the HEXAGONAL ball zones 11 (or the alternatively possible star parts 31) be formed as a cohesive one-piece component, whereas the pentagonal ball zones 12 (as in the state of the art) are formed as separate parts (for instance being stamped out). In that case and in relation to the partial view of FIG. 1, stitching shall take place not only along the edges 21 through 29 but also at the edges 16, 18 and 20. The advantage of this variation is that thereby the extra material for the required addition of a seam at the edges to be stitched, namely 16, 18, 20 and 21 through 29, is more easily provided than when the ball casing consists of a single cohesive cutout (as shown in FIG. 1). As regards the above modification a total saving of nineteen stitching sites is achieved relative to the ball casing of the same pattern in the state of the art.

In the embodiment of FIGS. 2 and 3, the ball casing 30 shown therein is composed of a total of twenty three-arm star ball zones 31 plus twelve equilateral pentagonal ball zones 12. (Twenty equilateral hexagonal ball zones denoted by 11 in FIG. 1 may just as well be used instead of the three-arm star ball zones 31). The pentagonal ball zones 12 correspond to those of the embodiment of FIG. 1. They are shown in FIG. 3, but not in FIG. 2. FIG. 2 shows that all three-arm star ball zones 31 are integrally joined into a single cutout 32. The conceptual connecting lines are indicated in broken lines 33 merely for better representation. All pentagonal ball zones 12 are stitched at all their edges to the integral cutout 32 (FIG. 2) to form the finished, spherical ball casing 30 shown in FIG. 3. In the process individual, free edges of the star ball zones 31 are stitched to one another namely, to the extent visible in FIG. 3, at 34, 35 and 36. Thereupon always five three-arm star ball zones 31 are placed around the pentagonal ball zones 12 (FIG. 3).

Compared with a correspondingly patterned ball casing of the state of the art (German patent 37 26 830), this embodiment allows saving a total of nineteen stitching sites. Furthermore only thirteen individual parts, namely the cohesive cutout 32 and the twelve pentagonal ball zones 12 need be handled during manufacture, and this saving represents a significant simplification of the manufacturing process over that of the state of the art, for instance German patent 37 26 830) requiring handling a total of thirty-two individual parts.

Lastly it must be stressed that a ball manufactured using the ball casing 30 or 10 of the invention (FIGS. 2, 3 and 1) is endowed with optimal sphericity and accordingly is the equal in this respect to conventional designs wherein the ball casing is composed of a total of thirty-two individual parts.

As shown in particular by FIG. 4, the embodiment of FIGS. 4 and 5 is characterized in that each time four three-arm ball zones 31 are made of one piece as a common cutout. Accordingly the ball casing 37 of FIG. 5 comprises a total of five integral cutouts 38 through 42 stitched to one another at 43 through 46. The integral (seamless) connection sites are denoted for elucidation (as in FIGS. 2 and 3) by dashed lines 33. Again the three-arm star parts 31 shown in the embodiment of FIGS. 4 and 5 may be replaced just as well by hexagonal ball zones 11 (FIG. 1).

The ball casing 37 shown in FIG. 5 is completed similarly to the finishing of FIGS. 2 and 3 by a total of twelve pentagonal ball zones 12 in the form of individual cutouts which are stitched to the free edges of the cutouts 38 through 42 which in FIG. 4 form a prefabricated component 47. FIG. 5 makes it plain that in the process free edges from various three-arm star ball zones 31 are stitched to one another for instance at 48, 49, 50.

The embodiment of FIGS. 4 and 5 offers the particular advantage that the cutouts 38 through 42 evince optimal handling size and that they entail very little cutting waste when being made.

Moreover following from the above discussion, a total of seventeen cutouts (=parts 38 through 42 plus twelve pentagonal ball zones 12) is required in the embodiment of FIGS. 4 and 5, whereas a conventional ball casing composed of a total of thirty-two individual cutouts further requires fifteen seams.

In the embodiment of FIGS. 6 and 7, two three-arm star ball zones 31 are each time consolidated into one cutout whereby the ball casing 51 of FIG. 7 requires a total of ten such grouped cutouts which are denoted by 52 through 61 in FIG. 6. The integral (seamless) connection sites of the three-arm star ball zones 31 are shown in conceptual dashed lines 33 (as in FIGS. 2,3 and 4,5) for elucidation. The individual grouped cutouts 51 through 61 are stitched together at 62 through 70. As a result a component denoted by 71 and shown in FIG. 6 is obtained, which, similarly to the embodiments of FIGS. 2,3 and FIGS. 4, 5 is completed by a total of twelve pentagonal ball zones 12 in the form of individual cutouts which must be stitched to the free edges of the component 71 in order that the entire ball casing 51 as shown in FIG. 7 be obtained. In the process the free edges of several three-arm star ball zones 31 (see references 72, 73 in FIG. 7) are stitched to one another. (Again the three-arm star ball zones in the embodiment of FIGS. 6, 7 may be replaced by hexagonal ball zones 11 as in FIG. 1.)

The ball casing of FIGS. 6 composed of twenty-two individual cutouts (=group cutouts 52 through 61 plus twelve pentagonal ball zones 12) which are connected by a total of eighty individual seams. A saving of ten seam connections is achieved relative to a conventional ball casing (requiring ninety individual seams) composed of thirty-two individual cutouts.

The embodiments of FIGS. 4,5 and FIGS. 6, 7 in addition to the already cited advantages are characterized by the common advantage of entailing no higher material consumption than a conventional thirty-two zone ball casing. The same use of material being possible as for conventional ball zone cutouts, the prevailing effect is that at those sites where a seam is eliminated, also the seam of the ball zone drops out, and consequently material is being saved.

The feature of the embodiment of FIGS. 8, 9 is that each time ten three-arm star ball zones 31 are combined into a group cutout denoted in FIG. 8 by 74 and 75. The two group cutouts 74, 75 are stitched together at 76 (FIG. 8). Together with twelve pentagonal ball zones 12 (FIG. 9) stitched together with the group cutouts 74, 75, there results the ball casing 77 shown in FIG. 9 and composed of fourteen individual cutouts (74, 75 and twelve pentagonal ball zones 12). (Obviously equilateral hexagonal ball zones may be provided also in the embodiment of FIGS. 8; 9 instead of three-arm star ball zones 31).

The advantages made possible by the invention (in all its described embodiments) in the form of ball casings composed of thirty-two individual cutouts are once again summarized:

1. manufacturing is more economical because of the lesser number of seams, 2. it is simpler to handle a single cutout (FIG. 1), thirteen cutouts (FIGS. 2, 3), seventeen cutouts (FIGS. 4, 5), twenty-two cutouts (FIGS. 6, 7) or fourteen cutouts (FIGS. 8, 9) than thirty-two cutouts (in conventional ball casings)

3. material consumption in the embodiments of FIGS. 4, 5 and of FIGS. 6,7 is somewhat lower than for conventional ball casings 4. a significant reduction in weight of the ball casing is achieved in all shown embodiments because of the elimination of added seams at thirty-eight, thirty or twenty ball zone edges, 5. water absorption of the ball casing is reduced because of the lower number of seams, 6. the number of weak spots giving rise to damage by abrasion, seam defects or seam stressing is decreased 7. the mutually connected hexagonal ball zones 11 (FIG. 1) or the three-arm star ball zones 31 (FIGS. 2 through 9) of the ball casing of the invention form a lattice into the interstices of which are integrated the pentagonal ball zones 12; in conventional ball zones composed of thirty-two individual cutouts this lattice is interrupted by thirty seams, whereas in the ball casing of the invention it is interrupted only by eleven (FIGS. 2, 3) or by fifteen (FIGS. 4, 5) or by twenty (FIGS. 6, 7) seams; it follows advantageously that the ball casing is more cohesive, and this feature in turn offers significant effects: first of all the ball evinces surprisingly improved flight and bounce behavior relative to conventionally stitched bails; because of the higher cohesiveness of the ball casing, the stresses are spread more rapidly after kicking deformation; the inherent ball frequency is higher (comparable to a spring with a higher spring constant which evinces a natural frequency higher than a spring of lower spring constant); however higher frequencies are damped more quickly; this faster damping of the ball casing of the invention compared with conventional ball casings causes an advantageous smoother flight behavior and prevents the feared ball "flutter"

8. when the inside ball pressure is high, the ball casing of the invention expands less than a conventional ball casing; a ball made with a casing of the present invention therefore will very accurately retain its design surface; moreover the seams spread less; the seams evince fewer "teeth"; because the lattice of the hexagonal ball zones 11 (FIG. 1) or of the three-arm star ball zones 31 (FIGS. 2 through 9) is spread apart less, then all seams between the edges of the said ball zones (11 or 31) and the edges of the pentagonal ball zones 12 are spread apart less 9. lastly the invention offers the following substantial manufacturing advantage: in conventional balls of the initially cited kind, twenty to thirty-two individual ball zones are separately printed (with the particular pertinent design) at substantial expense; the present invention on the other hand allows minimizing the separate printing procedures to ten, five, two or even a single printing.

I claim:

1. A ball casing, for soccer balls, composed of flat cutouts stitched together at their edges, the surface of the ball casing evincing a pattern of a group of equilateral polygonal surfaces (12) defining pentagonal surfaces having five edges and a group of equilateral hexagonal surfaces (11) with the same edge-length as that of the polygonal surfaces (12), each polygonal surface (12) being surrounded by five hexagonal surfaces (11), characterized in that, a) a plurality of equilateral hexagonal surfaces (11) that are cohesive when in planar geometric development compose a flat, integral cutout, preferably a stamped cutout, and in that the individual polygonal parts (12) are stitched by all said five edges to the associated edge of the common, flat cutout(s) containing the hexagonal surface(s) (11).

2. A ball casing for soccer balls, composed of flat cutouts stitched to one another at their edges, the surface of the ball casing evincing a pattern of one group of equilateral polygonal surfaces (12) defining pentagonal surfaces having five edges and one group of three-arm star surfaces (31) of which the arm length always corresponds to half an edge length of the polygonal surfaces (12) and wherein each polygonal surface (12) is enclosed by five star surfaces (31), characterized in that, a) a plurality of three-arm star surfaces (31) which are cohesive in planar geometric development compose at least one integral, flat and preferably stamped cutout (32; 38 through 42; 52 through 61; 74, 75) and each polygonal surface (12) is in the form of a separate and stamped cutout, and in that the individual polygonal surfaces (12) are stitched each at all said five edges to the associated edges of the common flat cutout(s) (32 or 38 through 42; 52 through 61, 74, 75) containing the star surfaces (31).

3. Ball casing as claimed in claim 1, characterized in that said ball casing (30) is constituted of thirteen flat cutouts, namely twelve identical polygonal parts (12) and a single, integral cutout (32) composed of twenty identical three-arm star surfaces (31) or of twenty identical hexagonal surfaces (11).

4. Ball casing as claimed in claim 1, characterized in that said ball casing (37) is composed of seventeen flat cutouts, namely twelve identical polygonal parts (12) and five large integral cutouts (38 through 42), each of said cutouts (38 through 42) being constituted of four identical three-arm star surfaces (31) or of four identical hexagonal surfaces (11).

5. Ball casing as claimed in claim 1, characterized in that said ball casing (51) is composed of twenty-two flat cutouts, namely twelve identical polygonal parts (12) and ten integral cutouts (52 through 61), each composed of two identical three-arm star surfaces (31) or of two identical hexagonal surfaces (11).

6. Ball casing as claimed in claim 1, characterized in that said ball casing (77) is composed of fourteen flat cutouts, namely twelve identical polygonal parts (12) and two large, integral cutouts (75, 75) each consisting of ten identical three-arm star surfaces (31) or of ten identical hexagonal surfaces (11).

* * * * *